US008567412B2

(12) United States Patent
Emami

(10) Patent No.: US 8,567,412 B2
(45) Date of Patent: Oct. 29, 2013

(54) USE OF POLYPHENOL COMPOUNDS OR DERIVATIVES THEREOF AS FREE-RADICAL SCAVENGERS IN CIGARETTE FILTERS

(75) Inventor: Imam Emami, Paris (FR)

(73) Assignee: Biosyntec, Paris (FR)

( * ) Notice: Subject to any disclaimer, the term of this patent is extended or adjusted under 35 U.S.C. 154(b) by 0 days.

(21) Appl. No.: 13/471,495

(22) Filed: May 15, 2012

(65) Prior Publication Data

US 2012/0222691 A1 Sep. 6, 2012

Related U.S. Application Data

(63) Continuation-in-part of application No. 11/442,806, filed on May 30, 2006, now abandoned, which is a continuation of application No. 09/582,130, filed as application No. PCT/FR98/02868 on Dec. 23, 1998, now abandoned.

(30) Foreign Application Priority Data

Dec. 24, 1997 (FR) ..... 97 16522

(51) Int. Cl.
*A24B 15/18* (2006.01)

(52) U.S. Cl.
USPC ..... 131/334; 131/335

(58) Field of Classification Search
None
See application file for complete search history.

(56) References Cited

U.S. PATENT DOCUMENTS

| | | | |
|---|---|---|---|
| 4,738,857 | A | 4/1988 | Daher et al. |
| 5,026,550 | A | 6/1991 | Aeschbach et al. |
| 5,795,609 | A | 8/1998 | Aeschbach et al. |
| 6,326,504 | B1 | 12/2001 | Piquer et al. |
| 6,450,935 | B1 | 9/2002 | Haworth |
| 6,455,087 | B1 | 9/2002 | Nicola |
| 6,855,349 | B2 | 2/2005 | Greaves et al. |
| 2003/0049332 | A1 | 3/2003 | Greaves et al. |

FOREIGN PATENT DOCUMENTS

| | | |
|---|---|---|
| CN | 1145206 A | 3/1997 |
| EP | 728420 | 8/1996 |
| FR | 2 564 296 | 11/1985 |
| JP | 112-160737 | 6/1990 |
| JP | 112-127194 | 10/1990 |
| JP | 06-062824 | 3/1994 |
| JP | 7-196645 | 8/1995 |
| WO | WO 94/00138 | 1/1994 |
| WO | WO 96/10929 | 4/1996 |

OTHER PUBLICATIONS

Chemical Abstracts, vol. 128, No. 138713, p. 328, Jan. 5, 1998, XP-002098506.

Derwent Publications Ltd., AN 94-114240, JP 09 062824, Week 9414, WP-002098507, 1994.

Derwent Publications Ltd., AN 93-190688, JP 05 115 273, Week 9324, XP-002098508, 1993.

(Continued)

*Primary Examiner* — Michael J Felton

(74) *Attorney, Agent, or Firm* — Frommer Lawrence & Haug LLP; William S. Frommer

(57) ABSTRACT

This invention provides for reducing free-radicals from cigarette smoke by using a filter impregnated by an extract of a rosemary plant in oil, containing carnosol, rosmanol, rosmadial, carnosic acid, genkwanin and rosmarinic acid. The extract is obtained by extraction with an alcoholic solvent or an aqueous alcoholic solvent, followed by extraction with a supercritical fluid.

10 Claims, 1 Drawing Sheet

(56) References Cited

OTHER PUBLICATIONS

Yanishlieva-Maslarova et al. ("Sources of Natural Antioxidants") 2001.

http://www.dictionary.com/extract, Nov. 21, 2005.

Angioni et al., Chemical, Plant Genetic Differences, Antimicrobial and Antifungal Activity Investigation of the Essential Oil of *Rosmarinus officinalis* L., 2004.

J. Agric. Food Chem. 2004, 52, 3530-3535, Published on Web May 6, 2004.

Basaga, Huveyda, et al. Antioxidative and Free Radical Scavenging Properties of Rosemary Extract, Feb. 1997, Lebensmittel-Wissenschati und-Technologie, vol. 30, Issue 1, pp. 105-108, ISSN 0023-6438, DOI: 10.1006/fstl.1996.0127. (http://www.sciencedirect.com/science/article/B6WMV-45NJFDR-J/2/c7b41c698468986c30fab196cfecf.

Richheimer, Steven, et al., Antioxidant activity of lipid-soluble diterpenes from rosemary, 1996, Journal of the American Oil Chemists' Society, vol. 73, Issue 4, pp. 507-514, DOI: 10.1007/BF02523927, http://www.springerlink.com/content/q346317717343118.

Machine translation of CN 1145206A via China Patent Information Center, http://ensearch.sipo.gov.cn, Mar. 19, 1997.

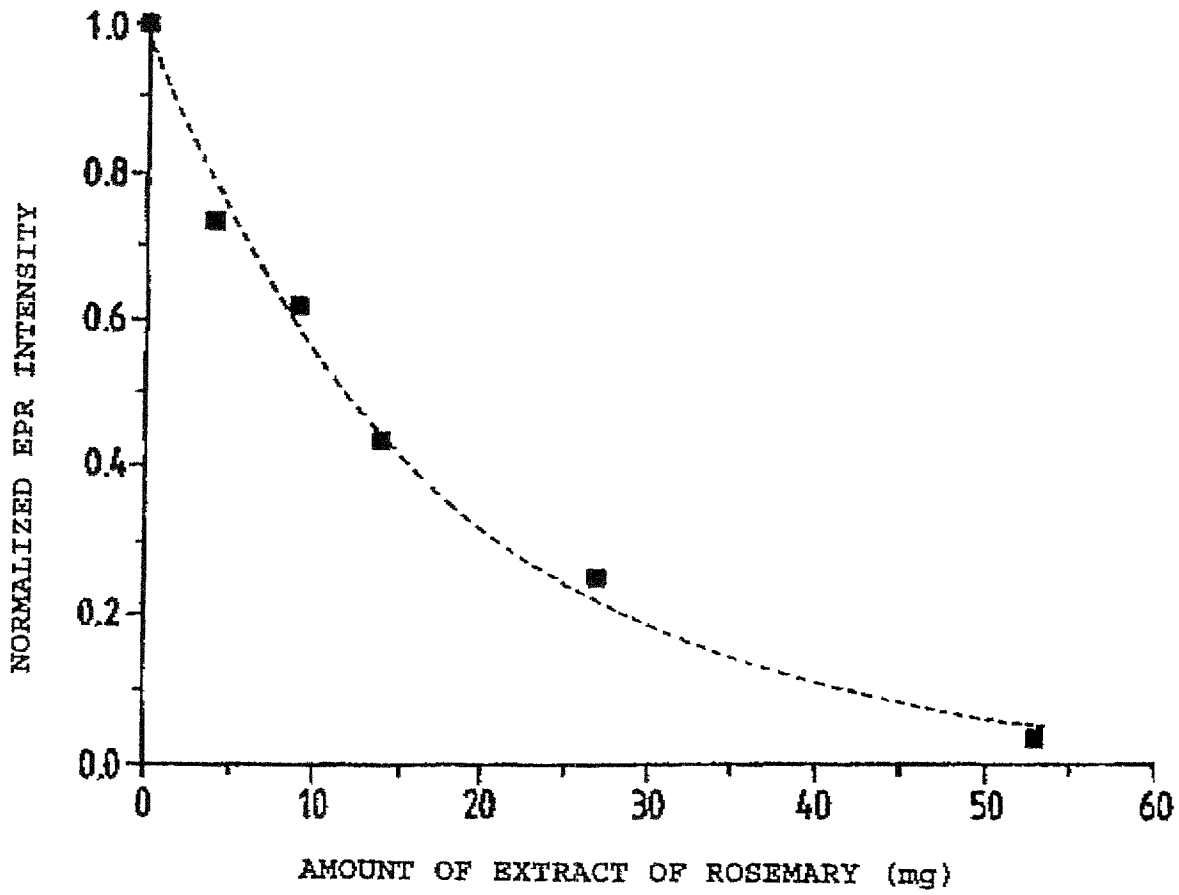
NORMALIZED EPR INTENSITY
1.0
0.8
0.6
0.4
0.2
0.0
0
10
20
30
40
50
60
AMOUNT OF EXTRACT OF ROSEMARY (mg)

USE OF POLYPHENOL COMPOUNDS OR DERIVATIVES THEREOF AS FREE-RADICAL SCAVENGERS IN CIGARETTE FILTERS

This is a division of application Ser. No. 11/442,806, filed May 30, 2006, now abandoned which is a continuation of application Ser. No. 09/582,130, filed Sep. 1, 2000, now abandoned which was filed pursuant to 35 USC 371, based on International Application PCT/FR98/02868, filed Dec. 23, 1998 and claims priority to French patent application 97/16522, filed Dec. 24, 1997, the entirety of which is incorporated herein by reference.

The present invention relates to the use of polyphenol compounds or derivatives thereof as free-radical scavengers in cigarette filters.

Many polyphenol compounds are known for their beneficial properties in fields as varied as hypertension, hypercholesterolaemia, involved in cardiovascular diseases, viral infections or inflammatory phenomena. The anti-lipoperoxidative and anti-carcinogenic activities of certain polyphenols have also been described.

Moreover, the incorporation of polyphenols from green tea into a cigarette filter has been envisaged to eliminate the unpleasant odour of cigarettes.

The authors of the present invention have now discovered that the incorporation of polyphenols or derivatives thereof in a cigarette filter makes it possible efficiently to remove the free radicals of the cytotoxic molecules of cigarette smoke during their passage through the filter.

The subject of the present invention is thus the use of polyphenol compounds as free-radical scavengers in cigarette filters.

The polyphenols used in accordance with the present invention can preferably be chosen from carnosol, rosmanol, rosmarinic acid and carnosic acid, and derivatives thereof.

The term "derivatives" in particular means compounds derived from polyphenol compounds by substituting the hydrogen atom of at least one of the hydroxyl groups of the polyphenol compounds with a $C_1$-$C_6$ alkyl group or a ($C_1$-$C_4$ alkyl)carbonyl group. Acetates such as carnosic acid acetates and rosmarinic acid acetates are preferred derivatives of the polyphenol compounds used in accordance with the invention.

The term "derivatives" of the polyphenols used in accordance with the invention such as carnosol, rosmanol, rosmarinic acid and carnosic acid also means the isomers of the said polyphenols such as, in particular, epirosmanol and isorosmanol (Nakatani et al., Agric. Biol. Chem., 1984, vol. 48, No. 8, pp. 2081-2085).

These compounds can be obtained by conventional chemical synthesis or by biotechnological synthesis, according to processes that are known to those skilled in the art. They can also be isolated from plant extracts.

The said polyphenols can also be used according to the present invention in the form of a plant extract, preferably an extract of a plant from the Labiatae family, in particular such as an extract of rosemary (*Rosmarinus officinalis* L.).

Such a plant extract can be obtained by extraction with a polar solvent such as an alcoholic or aqueous-alcoholic solvent. The alcohol used as solvent can in particular be ethanol. This extract can also advantageously be obtained using supercritical carbon dioxide and, in that case, is richer in polyphenol compounds.

The plant extract used according to the invention can preferably be obtained by extraction with a polar solvent followed by an extraction with supercritical $CO_2$.

The extraction of rosemary is preferably carried out on dried plants, for example on rosemary branches, chopped and dried in the sun for 4 to 5 days.

The polyphenol compounds or derivatives thereof, obtained by chemical or biotechnological synthesis or by extraction from plants, can be used alone or as a mixture in accordance with the invention.

Preferably, a mixture of carnosol, carnosic acid and rosmarinic acid may be used advantageously.

The polyphenol compounds or derivatives thereof can be used in free form or can be conjugated or coupled to a carrier, making it possible to increase the weight of the polyphenol-carrier assembly.

Microbeads may in particular serve as carrier. They may be made, for example, of plastic (polystyrene or the like) or of glass.

The polyphenol compounds can be, incorporated into the cigarette filters in a proportion of from 0.5 mg to 0.5 gram, preferably 0.002 gram to 0.1 gram, preferably 0.01 gram.

When the polyphenol compounds are dissolved in a solvent, the cigarette filter can advantageously be soaked with the said solvent containing the polyphenols, followed by evaporation of the said solvent. More particularly, the cigarette filter can be soaked with an alcoholic or aqueous-alcoholic plant extract and then subjected to evaporation of the alcoholic or aqueous-alcoholic solvent.

The polyphenol compounds or derivatives thereof can also be dissolved in a saturated oil, and thus incorporated into the cigarette filter.

A subject of the invention is also a process for preparing a cigarette filter, in which polyphenol compounds chosen from carnosol, rosmanol, rosmarinic acid and carnosic acid, and derivatives thereof, are incorporated into the said cigarette filter.

Another subject of the invention is a cigarette filter obtained by the above process. Such a filter makes it possible to reduce the amount of free-radical molecules present in cigarette smoke.

The authors of the present invention have discovered that polyphenols or derivatives thereof incorporated into a cigarette filter trap the free radicals of the cytotoxic molecules present in cigarette smoke, both in the aqueous phase and in the solid phase of the smoke, which consists essentially of tars.

These cytotoxic molecules promote the development of cancers in smokers, in particular lung cancer.

The polyphenols or derivatives thereof incorporated into a cigarette filter also exhibit, firstly, inhibition of the activity of the carcinogenic compounds by reducing the formation of heterocyclic amines during the combustion of the tobacco, and, secondly, a detoxification of the carcinogenic compounds, such as benzopyrene.

The FIGURE and the examples which follow illustrate the invention without limiting its scope.

The attached FIGURE is a graph representing the intensity of the signal, in electron paramagnetic resonance, of the tert-butyloxy radicals in the gas phase of the cigarette smoke as a function of the amount of extract of rosemary incorporated into the filter.

EXAMPLE

A—Preparation of an Extract of Rosemary

Spikes of rosemary (*Rosmarinus officinalis* L.) are subjected to extraction with ethanol at 65° C. The volume of ethanol used (in litres) corresponds to five times the weight in kg of the rosemary spikes.

The extract is then purified and enriched in polyphenols by selective extraction with supercritical $CO_2$. Depending on the temperature adjustment made between 40° C. and 100° C. and on the pressure adjustment made between 1 and 170 bar, the extract is purified and selectively enriched in its various components.

Such an extract contains the following compounds:

carnosol, rosmanol, rosmadial, carnosic acid, genkwanine, rosmarinic acid, etc.

The proportions of these various components vary according to the rosemary plant used. Generally, an extract comprising about 25% rosmarinic acid, about 10% carnosic acid, and about 5% carnosol is obtained.

B—Incorporation of the Extract into a Cigarette Filter

A cigarette filter is soaked either with the extract prepared, the ethanol then being evaporated off, or with an oily phase based on Crodamol® (Française d'Arômes et Parfums), in which a powder obtained by drying the extract prepared above is dissolved.

C—Efficacy of the Filter Containing the Polyphenols

1. Computer-Assisted Modelling:

The efficacy of the cigarette filter thus prepared is demonstrated in a first stage by computer-assisted modelling, according to the Monte-Carlo method, which makes it possible to calculate the number of encounters between a carcinogenic target molecule and a polyphenol compound used in accordance with the invention.

The number of cytotoxic molecules containing free radicals present in the cigarette smoke was calculated on either side of the filter.

The number of cytotoxic molecules is a function of the volume of smoke passing through the filter, the volume of the filter, the concentration of cytotoxic molecules in the smoke and the concentration of polyphenols in the filter.

The authors of the present invention have thus shown that 0.01 g of the extract of rosemary incorporated into a cigarette filter makes it possible to reduce the level of molecules containing cytotoxic free radicals in the cigarette smoke by more than 70%.

2. Electron Paramagnetic Resonance:

The radical-scavenging activity of the extract comprising carnosol, rosmarinic acid and carnosic acid was confirmed by Electron Paramagnetic Resonance (EPR) spectroscopy, optionally using the "spin-trapping" method.

a. Materials and Methods

EPR is a technique which makes it possible to study paramagnetic substances directly or indirectly. Paramagnetic compounds are molecules containing a single unpaired electron in their outer valence shell. Such substances are denoted by the term "radicals". When these radicals have very short lifetimes (very much less than one second), it is advantageous to use the "spin-trapping" technique. This consists in using traps capable of stabilizing the radicals produced by the formation of an adduct, and thus of measuring them over several minutes. This reaction takes place in the following way:

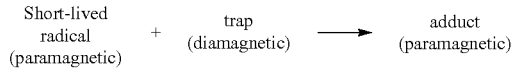

DMPO (5,5'-dimethylpyrroline N-oxide) was used as the "trap".

Radical-Scavenging Activity on the Radicals Produced in the Gas Phase of Cigarette Smoke:

The device for trapping the radicals of the gas phase of cigarette smoke is described in Pryor et al., Environmental Health Perspectives, 1976, vol. 16, pp. 161-175.

A cigarette is placed at the end of such a device, and the gas phase of the smoke, after passing through a Cambridge filter (finer than a cigarette filter in order to retain the tars), is dissolved in a "spin-trap" benzene solution.

For each measurement the DMPO is adjusted to a concentration of 32 mM in a solution of benzene and the gas phase of two cigarettes is used.

Radical-Scavenging Activity on the Semiquinone Radical Contained in the Solid Phase of the Cigarette Filter:

Besides the free radicals produced in the gas phase of the smoke, free radicals are also present in the tars which are partially stopped by the solid phase of conventional commercial filters.

The radical, which is mainly present in these tars and which is responsible for a carcinogenic activity that has been well-established to date, is of semiquinone nature. This semiquinone, which has a long lifetime, is able to react in cells and thus produce harmful species such as oxygen-containing radicals.

A second series of experiments consisted in studying the semiquinone radical contained in the solid phase of the filter. This study does not require the use of traps. Specifically, the detection of the radical, which has a very long lifetime, is made in situ on the filter recovered.

b. Results

Efficacy in Solution of the Extract of Rosemary in Trapping Free Radicals Produced in the Gas Phase In order to evaluate the ability of the extract of rosemary to trap the radicals in the gas phase of cigarette smoke in solution in benzene, the intensity of the EPR signal of the tert-butyloxy radicals was evaluated as a function of the amount of extract of rosemary added to the trapping solution, expressed in grams of dried powdered extract.

A decrease in the signal indicates that the extract of rosemary has a higher radical-trapping rate than that of DMPO (cf. FIGURE).

Efficacy of the Extract of Rosemary in Trapping Radicals Produced in the Gas Phase, after Impregnating the Filter with Dried Extract of Rosemary Dissolved in Crodamol®:

The filter was impregnated with 250 μl of the Crodamol®-based lipid phase, containing 10 mg/ml of dried powdered extract of rosemary.

EPR analysis of the spectrum of the tert-butyloxy (tBuO°) radical dissolved in benzene made it possible to observe a 65% decrease in the signal of the DMPO/tBuO° adduct. This result shows that the extract of rosemary used is effective in inhibiting the formation of the tBuO° radicals.

Efficacy of the Extract at Rosemary in Trapping Radicals Produced in the Solid Phase, after Impregnating the Filter with Dried Extract of Rosemary Dissolved in Crodamol®:

In parallel with the experiment carried out above, the signal of the semiquinone radical present in the cigarette filter was evaluated.

A decrease of about 63% in the semiquinone signal was observed after treatment of the filter with the extract of rosemary. Furthermore, it is interesting to note that no new signals appear which could indicate the formation of new radicals due to the trapping by the extract of rosemary. Consequently, these results show that the extract of rosemary is active as regards its ability to quench the semiquinone signal, and that it does not undergo, during this reaction, any conversion generating a new radical.

The invention claimed is:

1. A method for reducing free-radicals from cigarette smoke generated by smoking a cigarette having a filter, said method comprising the steps of passing the cigarette smoke through the filter wherein said filter is impregnated by an extract of a rosemary plant in oil wherein said extract is obtaining by the steps of:

(a) extraction with an alcoholic solvent or an aqueous alcoholic solvent, followed by (b) extraction with a supercritical fluid;

wherein the extract contains carnosol, rosmanol, rosmadial, carnosic acid, genkwanin and rosmarinic acid.

2. The method according to claim 1, wherein the alcoholic solvent or an aqueous alcoholic solvent is ethanol.

3. The method according to claim 2, wherein the supercritical fluid is supercritical $CO_2$.

4. The method according to claim 3, wherein the carnosol, rosmanol, rosmadial, carnosic acid, genkwanin or rosmarinic acid is coupled to a polymeric carrier or is in a microcapsule matrix or is added to the fibers of a filter.

5. The method according to claim 3, wherein the amount of rosmarinic acid, carnosic acid and carnosol in said extract is about 25% by weight, about 10% by weight and about 5% by weight, respectively, based on the total weight of the extract.

6. The method according to claim 3, wherein the amount of cytotoxic free radical molecules in cigarette smoke is reduced by more than 70%.

7. The method according to claim 3, wherein the amount of carnosol, rosmanol, rosmadial, carnosic acid, genkwanin and rosmarinic acid incorporated into the cigarette filters is from 0.002 g to 0.1 g.

8. The method according to claim 5, wherein the amount of cytotoxic free radical molecules in cigarette smoke is reduced by more than 70%.

9. The method according to claim 8, wherein the amount of carnosol, rosmanol, rosmadial, carnosic acid, genkwanin and rosmarinic acid incorporated into the cigarette filters is from 0.002 g to 0.1 g.

10. The method according to claim 1, wherein the rosemary extract is 80% by weight based on the total weight of the rosemary extract and oil.

* * * * *